US008418988B2

(12) United States Patent
Aicher

(10) Patent No.: US 8,418,988 B2
(45) Date of Patent: Apr. 16, 2013

(54) FORMWORK TIE ROD HAVING CONICAL PLASTIC SHEATH

(75) Inventor: Max Aicher, Freilassing (DE)

(73) Assignee: Stahlwerk Annahuette Max Aicher GmbH & Co. KG, Munich (DE)

( * ) Notice: Subject to any disclaimer, the term of this patent is extended or adjusted under 35 U.S.C. 154(b) by 349 days.

(21) Appl. No.: 12/452,343

(22) PCT Filed: Jun. 30, 2008

(86) PCT No.: PCT/EP2008/005327
§ 371 (c)(1),
(2), (4) Date: Jul. 22, 2010

(87) PCT Pub. No.: WO2009/003667
PCT Pub. Date: Jan. 8, 2009

(65) Prior Publication Data

US 2011/0114820 A1 May 19, 2011

(30) Foreign Application Priority Data

Jul. 4, 2007 (DE) ..... 10 2007 031 107

(51) Int. Cl.
*E04G 17/06* (2006.01)

(52) U.S. Cl.
USPC ..... 249/213; 249/43

(58) Field of Classification Search ..... 249/43, 249/213; 52/834
See application file for complete search history.

(56) References Cited

U.S. PATENT DOCUMENTS

| | | | | |
|---|---|---|---|---|
| 954,636 | A * | 4/1910 | Kurman | 249/43 |
| 1,311,036 | A * | 7/1919 | Birch | 249/43 |
| 2,709,292 | A * | 5/1955 | Otti | 249/43 |
| 3,648,961 | A * | 3/1972 | Farrow | 249/43 |
| 4,159,097 | A * | 6/1979 | Strickland | 249/40 |
| 6,837,473 | B2 * | 1/2005 | Petkau | 249/216 |
| 2003/0071189 | A1 * | 4/2003 | Petkau | 249/190 |

FOREIGN PATENT DOCUMENTS

WO WO2003/033836 * 4/2003

* cited by examiner

*Primary Examiner* — Michael Safavi
(74) *Attorney, Agent, or Firm* — Miller Canfield Paddock and Stone; Mark L. Maki

(57) ABSTRACT

A formwork tie rod (1) which is provided with a thread on the end portions (2, 3) has a conical plastic sheath (4) between the threaded portions (2, 3) for removal from the hardened concrete. For form-fitting connection to the plastic sheath (4) the tie rod (1) is provided with projections between the threaded portions (2, 3).

10 Claims, 1 Drawing Sheet

FORMWORK TIE ROD HAVING CONICAL PLASTIC SHEATH

Figure 1:
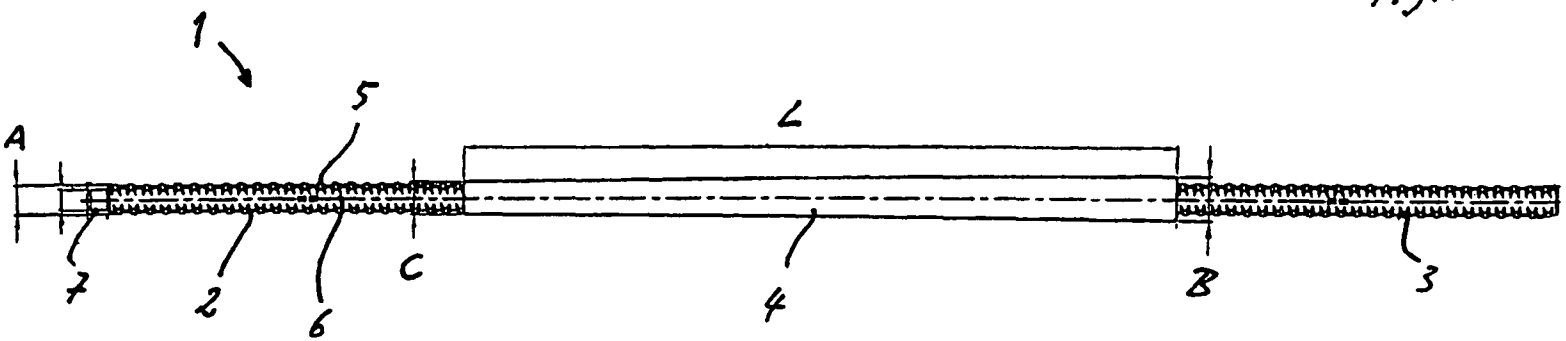

This invention relates to a formwork tie rod according to the preamble of claim 1.

The tie rods with which formwork walls are clamped together can either remain in the concrete after hardening. However, they are preferably removed from the concrete to be able to be reused.

For this purpose, the tie rod can be of conical configuration in the middle area. When the end of the tie rod facing the tapered end of the cone is then struck, the tie rod can be detached and drawn out of the concrete.

From CA 2,515,758 A1 there is already known a tie rod according to the preamble of claim 1. The middle portion is formed here by a steel cone to which the two threaded portions are welded. However, there is also known a tie rod wherein the threaded portions and the steel cone are integrally formed from a steel blank.

Both known tie rods possess only a low load-carrying capacity, however. With the steel cone having the welded threaded portions this is due to the welds, and with the integral tie rod it is due to the fact that compromises must be made with respect to the hardness of the steel because of the forming from the steel blank.

The object of the invention is to provide a reusable tie rod of high load-carrying capacity.

This is achieved according to the invention by the tie rod characterized in claim 1. In the subclaims there are stated advantageous embodiments of the invention.

According to the invention, the tie rod or formwork tie has projections between the thread on the two end portions, for form-fitting connection to a plastic sheath forming the conical portion. The tie rod consists of high-strength steel and preferably has a quality or yield point of more than 500 N/mm$^2$.

The tie rod is preferably formed here by a threaded rod which has a yield point of at least 700 N/mm$^2$, in particular at least 900 N/mm$^2$, and a tensile strength of at least 900 N/mm$^2$, in particular at least 1100 N/mm$^2$. The nominal diameter of the threaded rod is preferably at least 10 mm, in particular at least 15 mm, and particularly preferably between 15 and 30 mm.

The thread in the middle area of the threaded rod forms the projections with which the conical plastic sheath is so firmly anchored by form-fitting connection to the tie rod that the plastic sheath is not detached when the tie rod is struck out or pulled out of the hardened concrete. The threaded rod can be a hot-rolled or cold-rolled threaded rod, a hot-rolled threaded rod being generally preferable.

The plastic sheath is fixed by the projections or thread ribs against displacement in the axial direction. For this purpose, the projections or thread ribs must penetrate into the plastic sheath as far as possible.

To connect the conical plastic sheath to the tie rod form-fittingly, the plastic sheath is hence applied to the tie rod preferably by a shaping process. For this purpose, the plastic sheathe can be applied to the tie rod by injection molding, compression molding or casting or extrusion, or by vulcanization. Thus, the plastic extends form-fittingly into the spaces between the projections or thread ribs.

The plastic can be e.g. polyurethane, polyamide or polyethylene, polypropylene, or any other plastic. It is only essential that the plastic has no reactive groups so that it does not combine with the hardened concrete. Further, the plastic sheath should not be too hard and thus not too brittle so as to resist the loads at a building site, but also so as not to be damaged upon removal from the concrete. Hence, the elastic modulus of the plastic is preferably between 100 and 10000 MPa, in particular 500 to 5000 MPa. Furthermore, the plastic should be resistant to formwork oils and similar materials at a building site.

The conical plastic sheath has an external diameter such that it covers all projections between the two threaded portions at the ends of the tie rod, i.e. also the projections of the tie rod at its tapered end. That is, when a threaded rod is employed as a tie rod, the diameter of the plastic sheath is always greater than the outside rib dimension.

Preferably, the tie rod end that is struck or pulled on to remove the tie rod from the concrete is marked. For this purpose, the relevant end can be marked e.g. by removal of a small part of the thread at the rod end.

The inventive tie rod does not only possess a higher load-carrying capacity than conventional tie rods with the same diameter, it rather possesses the same high load-carrying capacity as non-reusable tie rods that remain in the concrete, because it can consist of the same steel.

Furthermore, compared with a conventional conical tie rod there is achieved a considerable weight reduction of generally more than 10%, in particular 30% and more. In addition, the plastic sheath has the advantage that it resumes its original form after deformation under concrete pressure on account of its elasticity (self-healing effect). Another advantage of the inventive tie rod consists in the fact that it can be easily detached even after repeated use. By contrast, it is unavoidable in known tie rods that the conical middle portion which consists of steel is roughened by corrosion in the course of time and can therefore not be detached easily or at all.

The ends of the conical plastic material can also have a certain form. Thus, the enlarged end of the plastic portion can have e.g. an annular shoulder.

Hereinafter the inventive tie rod will be explained more closely by way of example with reference to the attached drawing. Therein are shown:

FIG. 1 a plan view of a tie rod; and

Figure 2:
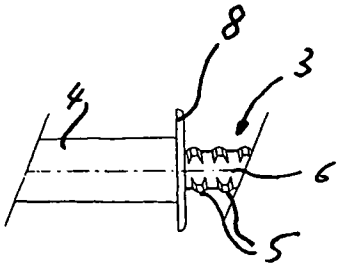

FIG. 2 a part of the tie rod in a modified embodiment.

According to FIG. 1, a tie rod 1 has at its two ends threaded portions 2, 3. Between the threaded portions 2, 3 there is provided a plastic sheath 4 which is configured concentrically with the tie rod 1.

The tie rod is formed by a threaded rod made of steel. The middle threaded portion of the threaded rod between the two end portions 2, 3 is for form-fitting anchoring of the plastic sheath 4. The plastic sheath 4 is for this purpose applied to the tie rod 1 by a shaping process, e.g. by injection molding.

The tie rod 1 can possess e.g. a nominal diameter A of 10 mm and more, whereby the thread ribs 5 can have for example a height of 1 to 5 mm. On account of its production by hot rolling it has plane-parallel faces 6 on opposing sides. The thread can of course also be configured circumferentially.

The conicity of the plastic sheath 4, i.e. the ratio from the difference between the external diameter B at the enlarged end and the external diameter C at the tapered end of the plastic sheath 4 based on length L, is preferably 0.5 to 2.5 mm, in particular 1 to 2 mm, per 100 mm L.

The length L of the plastic sheath 4 corresponds substantially to the distance between the formwork walls that are clamped with the tie rod 1.

On the threaded portion 2 neighboring to the tapered end of the plastic sheath 4 the thread is removed in the area 7 to form a marking for the tie rod end that is struck for detaching the tie rod 1 from the hardened concrete.

In the embodiment according to FIG. 2, the plastic sheath 4 has at its enlarged end an annular shoulder 8, the enlarged end extending through the formwork wall (not shown), so that the annular shoulder 8 lies against the formwork wall on the outside and forms a seal for the unfinished concrete.

The invention claimed is:

1. A formwork tie rod for use in a hardened concrete which said tie rod is formed by a threaded rod that includes threaded end portions and a middle threaded portion between said end portions, and which is provided, for removal from the hardened concrete, with a conical plastic sheath between the threaded end portions, said conical plastic sheath being connected form-fittingly to a thread of the threaded rod between the end portions, such that said threads form projections in said middle threaded portion and said plastic sheath is anchored to said middle threaded portion by penetration of said projections into said plastic sheath to prevent displacement of said plastic sheath in an axial direction extending along a length of said threaded rod, wherein the threaded rod is a hot-rolled threaded rod which has a yield point of at least 700 $N/m^2$, and wherein the conicity of the plastic sheath is 0.5 to 2.5 mm per 100 mm of length of the plastic sheath.

2. The tie rod according to claim 1, wherein the plastic sheath is so applied by a shaping process that it extends between the projections formed by the thread.

3. The tie rod according to claim 2, wherein one of said end portions defines a rod end that is struck or pulled on for removal of the tie rod from the hardened concrete, and wherein said rod end is provided with a marking.

4. The tie rod according to claim 3, wherein the plastic sheath has an annular shoulder at an enlarged end which projects radially outwardly of an outer conical surface of said plastic sheath at said enlarged end and is formed out of said plastic sheath as a single unitary piece.

5. The tie rod according to claim 2, wherein the plastic sheath has an annular shoulder at an enlarged end which projects radially outwardly of an outer conical surface of said plastic sheath at said enlarged end and is formed out of said plastic sheath as a single unitary piece.

6. The tie rod according to claim 1, wherein one of said end portions defines a rod end that is struck or pulled on for removal of the tie rod from the hardened concrete, wherein said rod end is provided with a marking.

7. The tie rod according to claim 6, wherein the plastic sheath has an annular shoulder at an enlarged end which projects radially outwardly of an outer conical surface of said plastic sheath at said enlarged end and is formed out of said plastic sheath as a single unitary piece.

8. The tie rod according to claim 1, wherein the plastic sheath has an annular shoulder at an enlarged end which projects radially outwardly of an outer conical surface of said plastic sheath at said enlarged end and is formed out of said plastic sheath as a single unitary piece.

9. The tie rod according to claim 1, wherein said tie rod has plane-parallel faces along a length thereof, where said faces are located circumferentially spaced from each other and said threads are formed by thread segments which are separated circumferentially by said faces disposed circumferentially between said thread segments.

10. The tie rod according to claim 9, wherein said plastic sheath is anchored on said threaded rod by said thread segments and said faces.

* * * * *